US005509527A

United States Patent [19]

Wang

[11] Patent Number: 5,509,527

[45] Date of Patent: Apr. 23, 1996

[54] CONVERTIBLE PENCIL BOX

[76] Inventor: Arthur J. Wang, 300 E. 40th St. Apt. 22-D, New York, N.Y. 10016

[21] Appl. No.: 368,380

[22] Filed: Jan. 4, 1995

[51] Int. Cl.[6] ..... B65D 85/28

[52] U.S. Cl. ..... 206/747; 206/747; 206/45.2; 206/214

[58] Field of Search ..... 206/45.11, 45.12, 206/45.15, 45.21, 45.22, 45.2, 45.23, 45.24, 214, 224, 371, 44

[56] References Cited

U.S. PATENT DOCUMENTS

| | | | |
|---|---|---|---|
| 2,020,876 | 11/1935 | Clark et al. | 206/45.12 |
| 2,085,649 | 6/1937 | Gluck | 206/45.12 |
| 2,315,999 | 4/1943 | Holm | 206/45.11 |
| 2,723,026 | 11/1955 | Paige | 206/45.12 |
| 2,983,372 | 5/1961 | Amatel et al. | 206/45.12 |
| 4,266,667 | 5/1981 | Ishigaki | 206/214 X |
| 5,107,985 | 4/1992 | Bezrutczyk et al. | 206/45.15 |

FOREIGN PATENT DOCUMENTS

| | | |
|---|---|---|
| 1049299 | 5/1955 | Germany . |

*Primary Examiner*—Jacob K. Ackun
*Attorney, Agent, or Firm*—Abelman, Frayne & Schwab

[57] ABSTRACT

A container for pencils and the like is convertible into a holder for those pencils by reversely folding an outer cover of the container at a position intermediate with lengths to provide two compartments in parallelism with each other, and which are usable as a pencil holder.

4 Claims, 3 Drawing Sheets

14
16
18
20
12
10
23
13
12a
12
13
21

13
12
13
14
16
10
22
20

37
36
38
30
32
32a
A
46
35
32
34
32a
37a
42a
40
A
A
36a
44
42
A
46a

CONVERTIBLE PENCIL BOX

FIELD OF THE INVENTION

This invention relates to a box for pencils, crayons, ball points and the like, that is convertible from a packaging for the pencils and the like to be employed at the point of sale, into a holder for the pencils and the like that can be employed for the storage and display of the pencils and the like by the purchaser.

BACKGROUND OF THE INVENTION

Pencils and the like commonly are sold in rectangular boxes having infolded ends, the purpose of the boxes being to confine a plurality of pencils and the like, for example, one dozen of those articles, in a convenient package for offer to a customer at the point of sale.

More commonly, the purchaser selects one of the pencils from the box for immediate use, and then stores the box and the remaining pencils in a drawer, or alternatively, if the stored items are crayons of different colors, the purchaser will withdraw all of the crayons from the box for alternative use, and then, return all of the crayons to the box for subsequent storage.

SUMMARY OF THE INVENTION

This invention proposes a box for pencils and the like, which, at the convenience of the user, can be converted into a holder for the group of pencils to provide convenient access to the pencils when placed on the users desk.

According to the present invention, the box for pencils and the like is comprised and axially straight tube of any desired transverse cross-section, one side of the tube being comprised of a planar wall.

The remaining side walls of the tube are provided with a transversely extending line of incisions or perforations, the incisions or perforations preferably are being arranged at a point mid length of the tube.

In its simplest form, the box is provided with infolded ends having a flap that is topped within the tube to locate the contents of the box within the tube.

To convert the box into a holder, it is merely necessary for the user to open one of the end flaps, withdraw the collection of pencils and the like, and then to fold the tube about the centrally positioned line of incisions or perforations such that the respective sections of the tube are folded reversely onto one another, and, the two sections of the planar wall all arranged in juxtaposition.

In another preferred embodiment of the invention, the box is provided with a slide tray, which is slide fitted within the tube with the longitudinally extending planar wall of the tube and the longitudinally extending planar wall of the slide tray in juxtaposition.

Intermediate it ends, the tubular outer member is provided with incisions or perforations in each of its walls other than the longitudinally extending planar wall. The incisions or perforations permit partial separation of the tubular member at the line of incisions or perforations, permitting the longitudinally extending planar wall then to be bent reversely onto itself for the two portions of the longitudinally extending planar wall to be arranged in juxtaposition.

In a similar manner, the slide tray is provided intermediate the ends of the longitudinally extending planar wall with a score line, or other line of weakening that will permit ready bending of the longitudinally extending planar wall reversely unto itself for the two portions of the longitudinally extending planar wall to lie in juxtaposition.

The reversely folded slide tray is then re-inserted into the reversely folded outer tubular member at that end of the tubular member comprised by the free end of the tubular member, and is passed axially within the tubular member to bring the reverse fold in the longitudinally extending planar wall of the slide tray into embracing relation with the free end of the longitudinally extending planar wall of the reversely folded outer tubular member.

In that condition, the reversely folded outer tubular member is locked in the reversely folded condition, and similarly, the reversely folded slide tray is locked within the reversely folded outer tubular member.

The structure thus constructed can then be moved to an upright position, in which it provides a holder for the pencils, crayons or the like, that previously were stored and vended in the tubular outer wall and slide tray prior to the reverse folding of those respective members and the interfitting of those members.

DESCRIPTION OF THE DRAWINGS

The invention will now be described in reference to the accompanying drawings, in which.

DESCRIPTION OF THE PREFERRED EMBODIMENTS

Figure 1:
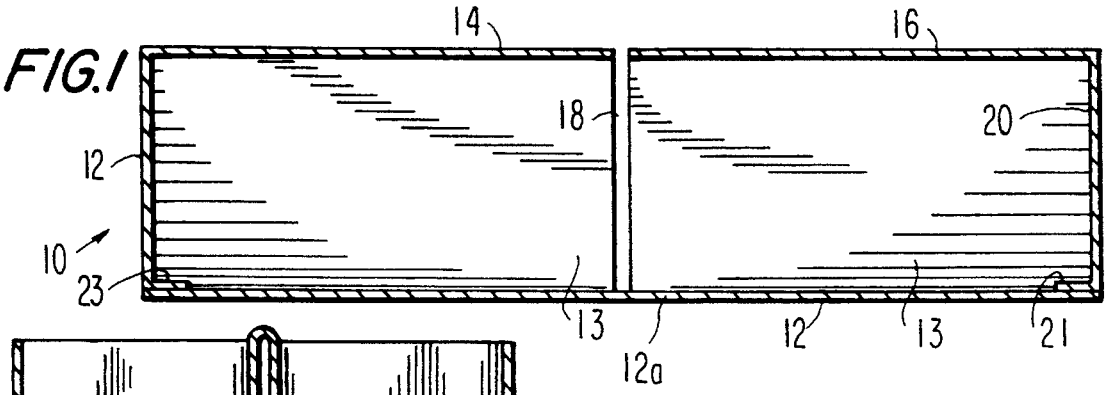
FIG. 1 is a longitudinally cross-section through one preferred embodiment of the convertible pencil box of the invention illustrating the basic construction thereof.

Referring firstly to FIG. 1, the convertible pencil box is indicated at 10, that box comprising a planar bottom wall 12 that is connected directly at its longitudinal edges to front and rear side walls 13. The side walls 13 are in turn directly connected to top walls 14 and 16, a transverse line of incisions or perforations being provided centrally of the side walls 13, and thus defining of the separate top walls 14 and 16.

The ends of the box, which conveniently is rectangular in transverse cross-section, are closed by end flaps 20 and 22, respectively having tuck-in tabs 21 and 23, which are inserted behind the planar wall 12 after filling of the box with pencils or the like.

When the box is filled, the pencils the like or extend continuously between the end walls 20 and 22, and the box is, by virtue of the contained pencils, entirely rigid in the longitudinal direction, and, can be handled at the point of sale in exactly the same manner as a conventional box of pencils.

Figure 2:
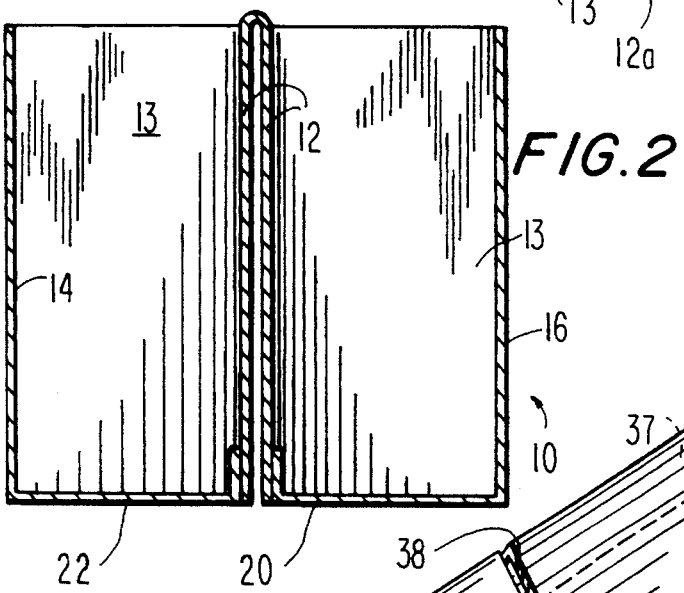
FIG. 2 illustrates the box of FIG. 2 when the two sections of the box are bent reversely onto each other and are locked in that condition by a pre-existing locking tab at one end of the box.

Once the pencils are removed from the box by the purchaser, the box itself can then be turned into a pencil holder, as is illustrated in FIG. 2 by folding the planar wall 12 reversely on itself about the point 12(*a*), which itself can be comprised of a line of scoring, subsequent to which the purchaser then inserts the tab 21 of the end wall 20 for it to be juxtaposed between the tab 23 of the end wall 22 and the adjacent wall of the reversely bent planar member 12.

When so assembled, the box is converted into a pencil holder having two open wells, each of which can receive pencils or the like that are positioned therein, the holder being entirely stable on a flat surface, such as a work-table or drawing board.

The provision of a central incision, such as the incision 18, has the advantage that the purchaser can view the contents of the box prior to purchase, in order to insure that the box is completely filled, and, that it is filled with the pencils that the purchaser intends to purchase.

Figure 3:
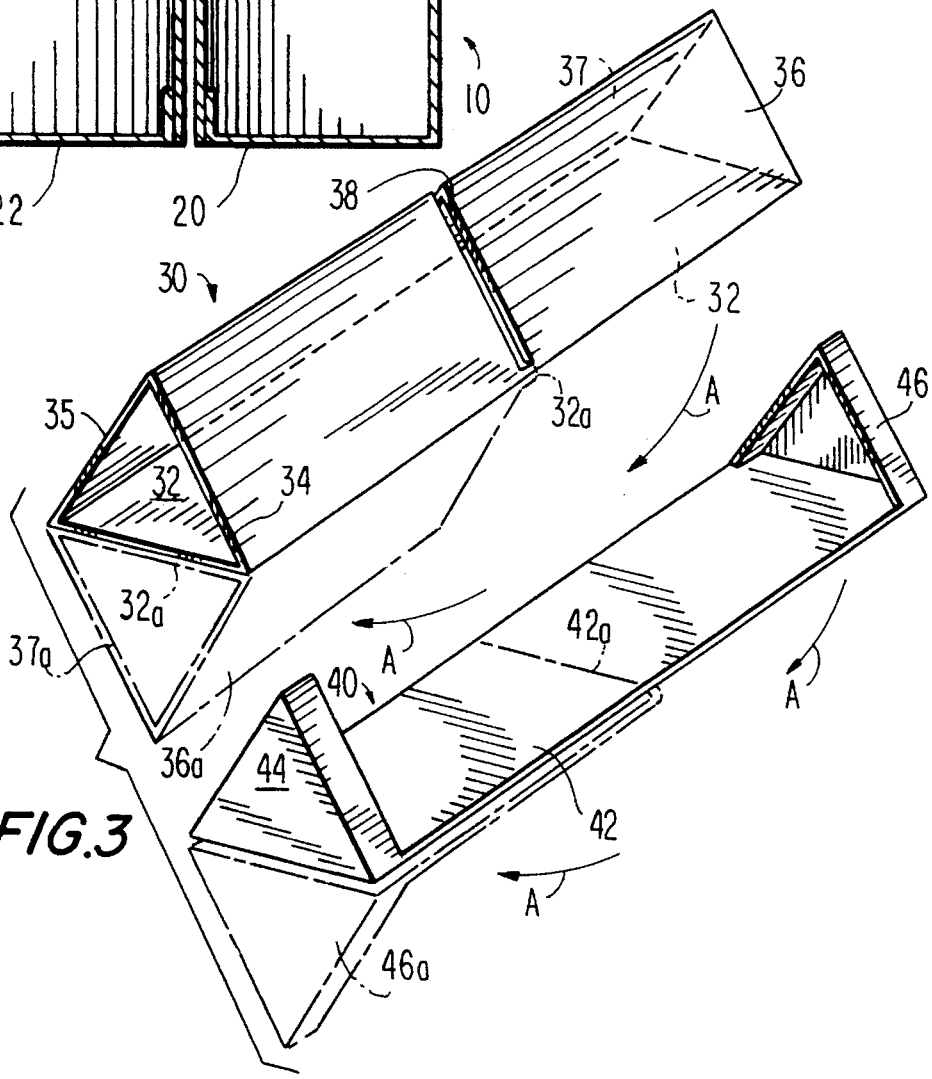
FIG. 3 is an exploded perspective view of another embodiment of the invention, showing the axially straight tubular outer container prior to folding, and, the axially straight slide tray prior to folding, the manner of folding of the respective tubular outer container and slide tray being indicated in chain dotted lines.

Referring now to FIG. 3, there is shown an alternative, and preferred, form of the box according to the present invention.

In FIG. 3 the box is indicated at 30, and is in the form of an axially straight triangular tube having a continuous planar bottom wall 32 that is connected directly with side walls 34 and 35 comprising one half of the length of the tube, and side walls 36 and 37 comprising the other half of the length of the tube, the respective side walls being separated from each other in a direction longitudinally of the tube by a line of incisions or perforations 38.

By this construction, the tube 30 readily can be bent by the purchaser along a central line 32(*a*) extending transversely of the planar wall 32 for the planar wall 32, to be bent reversely on itself, such that the planar wall 32 and the side walls 36 and 37 are moved in the direction of the arrows A for them to lie in parallel juxtaposition with the remainder of the tube, the planar wall 32 and the side walls 36 and 37, then having been moved into the positions shown at 32(*a*), 36(*a*) and 37(*a*) in which they extend in parallelism with the remainder of the planar wall 32 and the side walls 34 and 35.

Positioned within the tube is a slide tray indicated generally at 40, the slide tray being comprised of a planar wall 42 and ends walls 44 and 46 that are configured for them to provide end closures for the tube 30.

In order to assemble the pencil holder from the box illustrated in FIG. 3, it is merely necessary for the purchaser to withdraw the slide tray 42, then hold the slide tray about the score line 42(*a*) in the direction of the arrows A, in order to bring the end wall 46 into the position 46(*a*) shown in chain dotted lines.

After this has been done, the purchaser then merely inserts the end walls 44 and 46(*a*) of the tray 40 into the free ends 32, 34, 35 and 32(*a*), 36(*a*) and 37(*a*) of the reversely folded tube 30, and then pushes the ends of the slide tray 40 axially within the two sections of the folded tube 30, until such time as the fold 42(*a*) comes into embracing engagement with the free edges 32 and 32(*a*) of the reversely folded tube.

This operation is illustrated diagrammatically in FIGS. 4–7.

Figure 4:
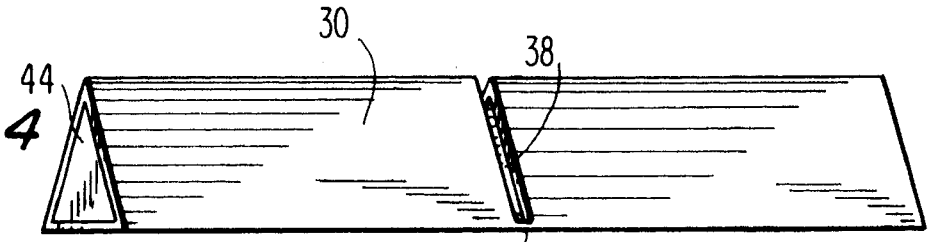
FIG. 4 is a diagrammatic illustration of the composite container of FIG. 3, as employed for the storage of pencils, crayons and the like, and the display of the packaged items at the point of sale.
Figure 5:
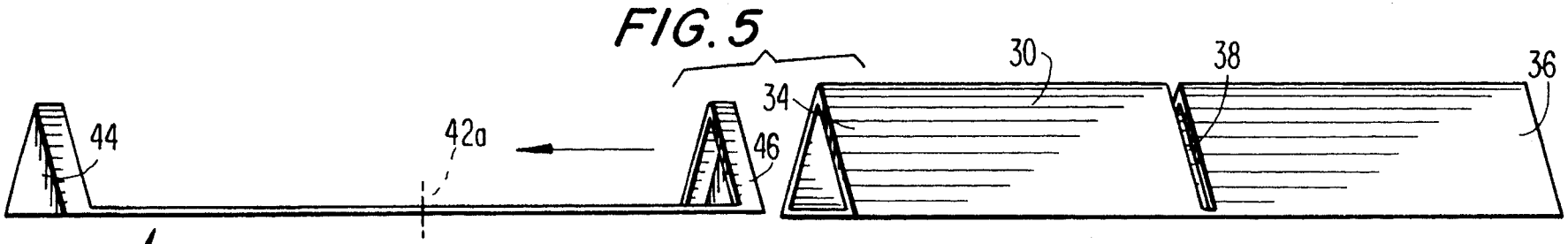
FIG. 5 illustrates diagrammatically the manner in which the slide tray and the tubular outer member are separated one from the other.
Figure 6:
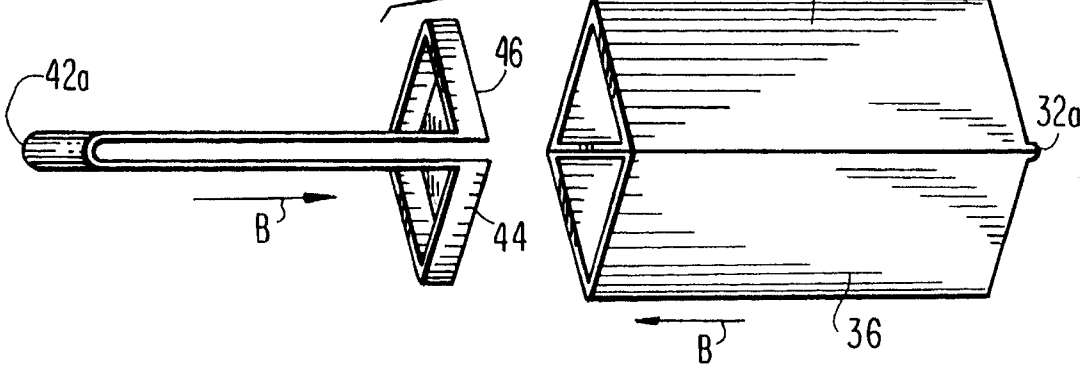
FIG. 6 is a diagrammatic illustration of the manner in which the tubular outer member and the slide tray are reversely folded on themselves and positioned ready for reassembly.
Figure 7:
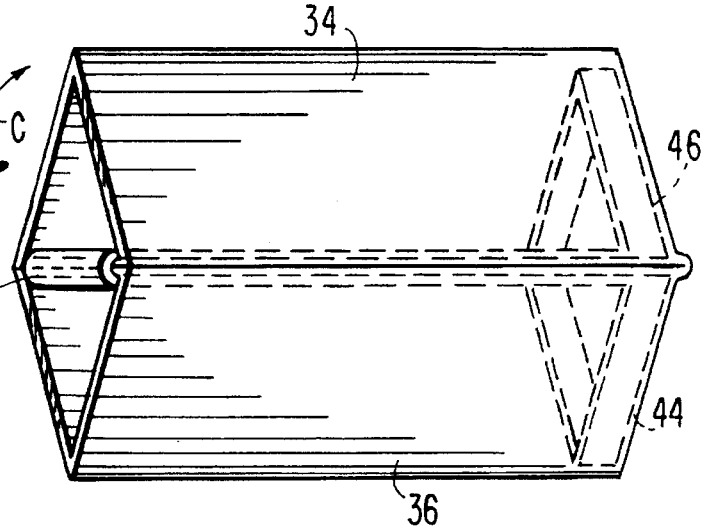
FIG. 7 diagrammatically illustrates the reversely folded outer tubular member and the reversely folded slide tray when interfitted one with the other; and, FIGS. 8, 9 and 10 illustrate various alternative forms that the respective outer tubular member and slide tray can take, and, various configurations that can be obtained as a pencil holder when the pencil box is converted into a pencil holder.
Figure 8:
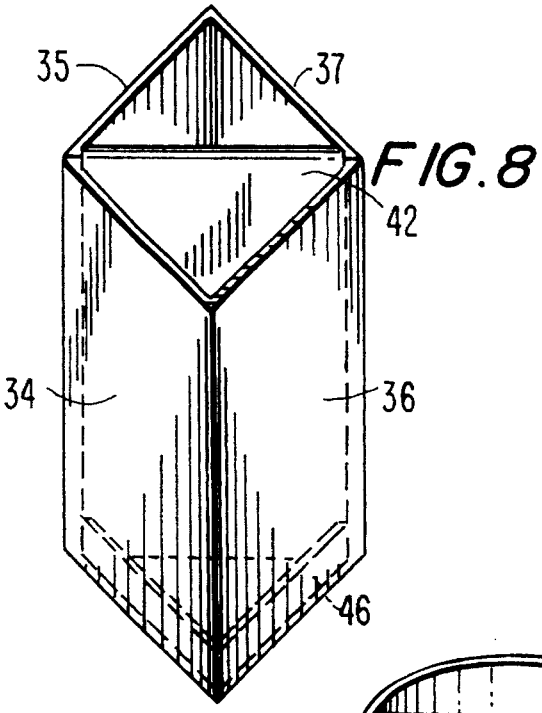

Commencing with the assembled pencil box as shown in FIG. 4, the tray 42 is removed axially from within the tube 30 as shown in FIG. 5, subsequent to which the respective tubular sleeve 30 and slide tray 40 are folded reversely upon themselves as illustrated in FIG. 6, and then, the respective members are moved towards each other in the directions of the arrows B, to move the tray inwardly of the reversely folded tubular sleeve, and lock the reversely folded tubular sleeve in the reversely folded condition, as illustrated in FIG. 7, subsequent to which the container can be oriented vertically to provide the pencil holder, by rotating it in the direction of the arrow C to the position indicated in FIG. 8.

The configurations of containers so far described result in a square or rectangular pencil holder when appropriately folded and assembled.

Figure 9:
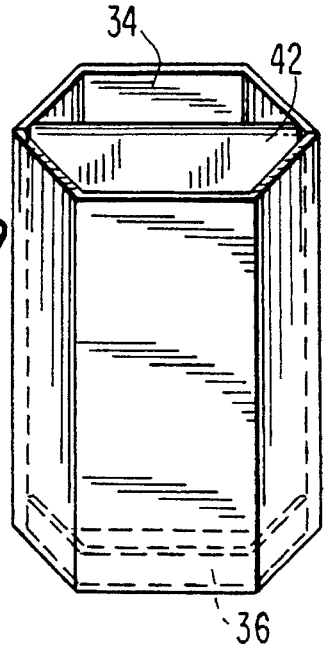
Figure 10:
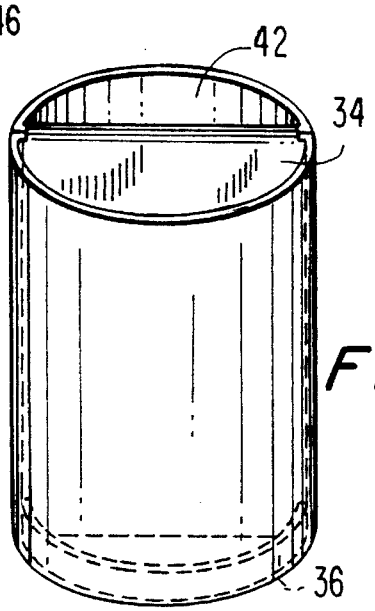

As is illustrated in FIG. 9, the pencil box and the assembled container can be other than square or rectangular, for example, the pencil box can be formed of trapezoidal cross-section, this resulting in the hexagonal form of pencil box as illustrated in FIG. 9, or, the walls 34–37 of the outer tubular sleeve can be in the form of a continuous curve, this resulting in a holder of cylindrical or ovate form, as illustrated in FIG. 10.

Various materials may be employed in the formation of the container and the slide tray. For example, the embodiment of FIG. 1 conveniently can be made from a stabilized paper board, such as is well-known in the art.

The tubular sleeve of the remaining FIGS. conveniently can be formed from a corrugated card board material, and optionally, the slide tray 42 can be formed from a similar corrugated card board material. In this latter event, preferably the container is wrapped with a removable material, such as cellophane, that has been appropriately printed with the manufacturers logos. This can be removed and discarded by the purchaser, the resultant pencil holder then being free of superfluous decorations, and, appropriately colored or color coded to indicate a group of pencils having a specific hardness.

Equally well, the tubular sleeve and the slide tray can be formed from a transparent sheet plastics material, or, can be formed from a relatively thin and hand bendable sheet metal.

I claim:

1. A container for elongate members, particularly pencils, crayons, and, ball point pens, comprising:

an axially-straight tubular member providing an outer cover for a group of said elongate members;

a continuous axially-straight planar wall comprising one axially extending wall of said tubular member;

axially and peripherally extending side walls of said tubular member interconnecting opposite axially extending lateral sides of said planar wall to provide said axially-straight tubular member;

a line of weakening extending transversely of said tubular member at a position intermediate opposite axial ends of said tubular member, said transverse line of weakening extending continuously transversely of each said axially extending peripheral side walls;

whereby, said axially extending peripheral side walls can be manually separated at said line of weakening to provide two interconnected sections of said axially-straight tubular member interconnected by said continuous axially-straight planar wall, then permitting reverse folding of said axially-straight planar wall at the juncture of said respective sections of said tubular member to provide a holder for said elongate members;

further including an axially-straight slide member receivable within said tubular member providing a slide tray having an axially-straight planar wall for supporting said elongate members end members of said slide tray providing end closures for said axially-straight tubular member and of complimentary outer periphery to the cross-section of said tubular member; and, a fold line in said axially-straight planar wall of said slide member extending transversely of said planar wall at a position corresponding with the fold line of said axially-straight planar wall of said tubular member;

whereby, said axially-straight planar wall of said slide tray can be reversely folded upon itself to permit interfitting of said ends of said slide tray within said respective sections of said reversely folded tubular member.

2. The container of claim 1, in which said axially and peripherally extending side walls of said tubular member, when viewed in transverse cross-section, are arranged in the form of a triangle.

3. The container of claim 1, in which said axially and peripherally extending side walls of said tubular member, when viewed in transverse cross-section, are arranged in the form of a polygon.

4. The container of claim 1, in which said axially extending peripheral side walls of said tubular member, when viewed in transverse cross-section, are in the form of a semi-circle.

* * * * *